US006246927B1

(12) United States Patent
Dratman

(10) Patent No.: US 6,246,927 B1
(45) Date of Patent: Jun. 12, 2001

(54) INTER-COOPERATING TOYS

(76) Inventor: Ralph Dratman, 121 Dumas Rd., Cherry Hill, NJ (US) 08003

( * ) Notice: Subject to any disclaimer, the term of this patent is extended or adjusted under 35 U.S.C. 154(b) by 0 days.

(21) Appl. No.: 09/355,787

(22) PCT Filed: May 1, 1998

(86) PCT No.: PCT/US98/08908

§ 371 Date: Aug. 3, 1999

§ 102(e) Date: Aug. 3, 1999

(87) PCT Pub. No.: WO98/50872

PCT Pub. Date: Nov. 12, 1998

Related U.S. Application Data

(60) Provisional application No. 60/042,916, filed on May 5, 1997.

(51) Int. Cl.[7] ..... G05B 19/04

(52) U.S. Cl. ..... 700/246; 700/83; 700/259; 446/436; 369/63; 701/25

(58) Field of Search ..... 700/83, 246, 245, 700/248; 446/436; 369/63; 701/25; 709/200; 318/568.12

(56) References Cited

U.S. PATENT DOCUMENTS 4,028,533 * 6/1977 Matsubara ..... 700/248
5,083,968 * 1/1992 Hart ..... 446/431
5,314,336 * 5/1994 Diamond et al. ..... 434/169
5,697,829 * 12/1997 Chainai et al. ..... 446/436
5,746,602 * 5/1998 Kikinis ..... 434/169

* cited by examiner

*Primary Examiner*—Paul P. Gordon
*Assistant Examiner*—Sheela Rao

(57) ABSTRACT

A method of managing a plurality of controllable objects in the storage and execution of instructions related to a performance of n desired actions comprising the steps of: (a) advising the plurality of objects that a first selected object is about to store instructions related to a performance of a first desired action; (b) storing, in the first object, instructions related to the performance of the first desired action; (c) advising the plurality of objects that the storing of the instructions in the first selected object has been completed; (d) preparing the plurality of objects to receive instructions related to a performance of a next desired action; (e) storing, in a next selected object, the instructions related to the performance of the next desired action; (f) advising the plurality of objects that the storing of the instructions in the next selected object has been completed; and (g) repeating steps (d) through (f) until instructions related to the performance of said n desired actions have been stored.

60 Claims, 9 Drawing Sheets

INTER-COOPERATING TOYS

This application claims the benefit of U.S. Provisional Application Ser. No. 60/042,916, filed May 5, 1997.

BACKGROUND OF THE INVENTION

Toys which simulate interaction between a group of objects are known. However, these toys are very limited. For example, toys exist in which the toy asks the user a question, and the user answers the question by depressing a button on the toy. The toy then determines whether the answer is correct or incorrect. Based upon this determination, the toy then outputs a preprogrammed message to the user stating whether the question was answered correctly or incorrectly. Then the toy is ready to ask another question. While this type of toy allows for a feeling of interaction between the doll and the user, it has a great number of drawbacks. Specifically, each of the questions and answers are pre-recorded on an audio tape. When a question is asked, the toy simply moves the tape to the proper location, and the question is played from the tape, and after the user answers, the toy moves the tape to the next location to play the next message. The user has no control over the content of, or voice used in the messages.

Additionally, such toys cannot interact with each other. Rather, each toy only interacts with a single user. Therefore, it would be beneficial to provide a toy which overcomes the shortcomings of the prior art, and which allows any number of toys, objects or units to interact with each other, and which allows a user to control sounds, movements and other actions performed by the toy.

SUMMARY OF THE INVENTION

This invention relates generally to an apparatus and method for allowing any number of toys or other objects to interact with each other. The invention also relates generally to an apparatus and method for allowing any number of toys or objects to be programmed and to play back the sequence of commands in a predetermined order, among all of the objects. The playback of the sequence of commands by the objects will create a unique play value because the objects will appear to be communicating with each other, and it is therefore possible for the user to program a conversation or other predetermined actions among the objects.

Generally speaking, in accordance with the invention, inter-cooperating objects are coupled by a communication medium at modest data transfer rates to sequence a series of events, including overlapping or simultaneous events. Sequence and event information is stored in a distributed, non-hierarchical fashion, involving an arbitrary number of devices. Neither a central controller nor any additional equipment, either for programming or for operation is necessarily required.

In a first preferred embodiment of the invention, any number of objects are provided, each comprising at least a processor, a memory, a transmitter and a receiver. Each memory is adapted to store a distinct code or plurality of codes representing an event code and, where appropriate, information representative of a predetermined action. Upon the actuation of a function in an arbitrarily user-selected first of the objects, an actuation signal is transmitted to each of the other objects informing them that the first object is storing information. This actuation signal is received by each of the other objects, each of these objects then being aware that one of the objects, in this case, the first object, is storing information. The event code and information is stored in the memory of the first object. Upon completion of the storage of the information, a second actuation signal is transmitted from the first object to all of the other objects informing them that the storage of information for the first event is complete. Each of the other objects receives this signal, and updates a counter to indicate that the next event stored by any object will be the second event. Then, upon actuation of a function in a second of the objects, an actuation signal is transmitted to each of the other objects informing them that another object, in this case, the second object is storing information. The second object may be either the same object or another of the plurality of objects. This actuation signal is received by each of the other objects, each of these objects then being aware that the second object is storing information. The event code and information is stored in the memory of the second object. Upon completion of the storage of the information, a second actuation signal is transmitted from the second object to all of the other objects informing them that the storage of information for the second event is complete. Each of the other objects receives this signal, and updates a counter to indicate that the next event will be the third event, so that the information stored by each of the objects may be replayed by the objects in the sequence of the event codes stored in the memory of these objects.

Additionally, the functioning of the invention does not require a plurality of objects. Specifically, one object alone will function similarly to the group of objects as noted above. However, only one unit will store information. Thus, in an additional embodiment a single object is provided, comprising at least a processor, a memory, a transmitter and a receiver. The memory is adapted to store a distinct plurality of codes representing an event code and, where appropriate, information representative of a predetermined action. Upon the activation of the storage sequence, the event code and information stored is stored in the memory of the first object. Upon completion of the storage of the information, the storage sequence is completed and the counter is updated to indicate that the next event will be the second event. Additional events may then be stored in the same manner.

A toy constructed in accordance with an exemplary embodiment includes a small microphone, two push button assemblies, an indicator light, a small loudspeaker, an infrared, or radio transmitter, and an infrared or radio receiver, mounted or concealed within the toy. (The transmitter and receiver might use other communication circuitry instead of infrared or radio signals, with no other changes to the descriptions below.) The push buttons are preferably labeled, or indicated by some other means, as being buttons for "Record" and "Play." Batteries, or other power sources, and the required electronics are retained inside the toy. Through the use of these features, as well as the required programming, as will be discussed below, this toy is able to store sound or other movements or commands or preprogrammed actions, and may be used to capture a number of separate recordings of speech (in any language), as well as song, music, or any other sounds. These sounds can then be played through the built-in speaker. Additionally, when more than one toy is present, the order of storing of each of the events is retained by each of the toys independently. Therefore, when playback begins, the events from each toy will be played back in the proper sequence, each of the toys waiting for the others to complete their prior event(s) before beginning its next event. While each toy unit has a hardware-defined limit on total storage time, there is no particular limit on the number of separate units of sound, or events, into which this total storing time may be divided. Furthermore, there is no limit on the number of devices which may interact.

During operation, each toy is capable of synchronized speech or action in any desired order. Synchronization of the stored sounds or actions during playback is mediated by infrared, radio or other communication between the individual toys. In such a performance, the order of speaking or acting is entirely configurable by the user, using a simple and intuitive procedure. As an event is stored with each toy, the toy informs each of the other toys that event 1 has been programmed. Thus, when the next event is programmed, regardless of which toy it is programmed into, that toy knows that the event will be event number 2. After this programming is completed, all of the toys are informed that event 2 has been programmed. Further events may be stored in a similar manner. Thus, a sequence of events is programmed in this manner.

During performance, each event is played back in sequence. The first event is played back. Upon completion of the playback of the first event by the unit which had stored the first event, all of the units are informed that the first event is complete. Then, whichever unit has the second event plays back this event and then informs all of the units that the second event is complete. In this manner, all of the stored events, regardless of which toy unit has stored them, will be played back in a predetermined sequence.

In a second preferred embodiment, instead of transmitting a message meaning <Event #n has been completed> during playback, a message meaning <Perform event #m> is transmitted. In this embodiment, m may equal n+1, in which case the message is the equivalent as in the first preferred embodiment, or m could equal any valid number. If m is not equal to n+1, then the message acts as a "goto" or jump or branch type message. The ability to perform a "goto" allows arbitrary flow-of-control constructs such as loops, conditional branches, multi-way case statements, subroutine calls using Boolean or small-integer values, as well as interrupts, and the like.

In a third preferred embodiment, arbitrary or randomly generated event numbers are substituted for the sequential event numbers. The arbitrary or randomly generated event numbers aid in preventing sequencing difficulties which may occur when one of the objects is unavailable, out of range, or not functioning at the time when the user is creating program steps for other objects.

In a fourth preferred embodiment, a fallback protocol is added to the system of any of the previous three embodiments. The fallback protocol provides the capability of skipping or overriding an object which fails to respond as expected during the playback sequence, which otherwise may have prevented the performance of the remaining sequence. In this embodiment, a prior acting object makes use of a wait time, and monitors the situation until the next object takes over. If the next performing object fails to respond in a set period of time, the prior-acting object may use the fallback protocol to skip past the non-responding object.

Alternatively, it would be possible to load a preprogrammed sequence of events, at one time, by radio communication or other appropriate signals. Thus, it would be possible to enter all of the required events for the toys to put on a play, or to act out a story. The voices and movements would be downloaded into each toy's memory, and the speeches and movements would be given the proper event numbers. Therefore, while the programming of each of the events would be performed at one time, the playback of each of the events would take place as in the prior embodiment when the user programmed each of the events individually.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
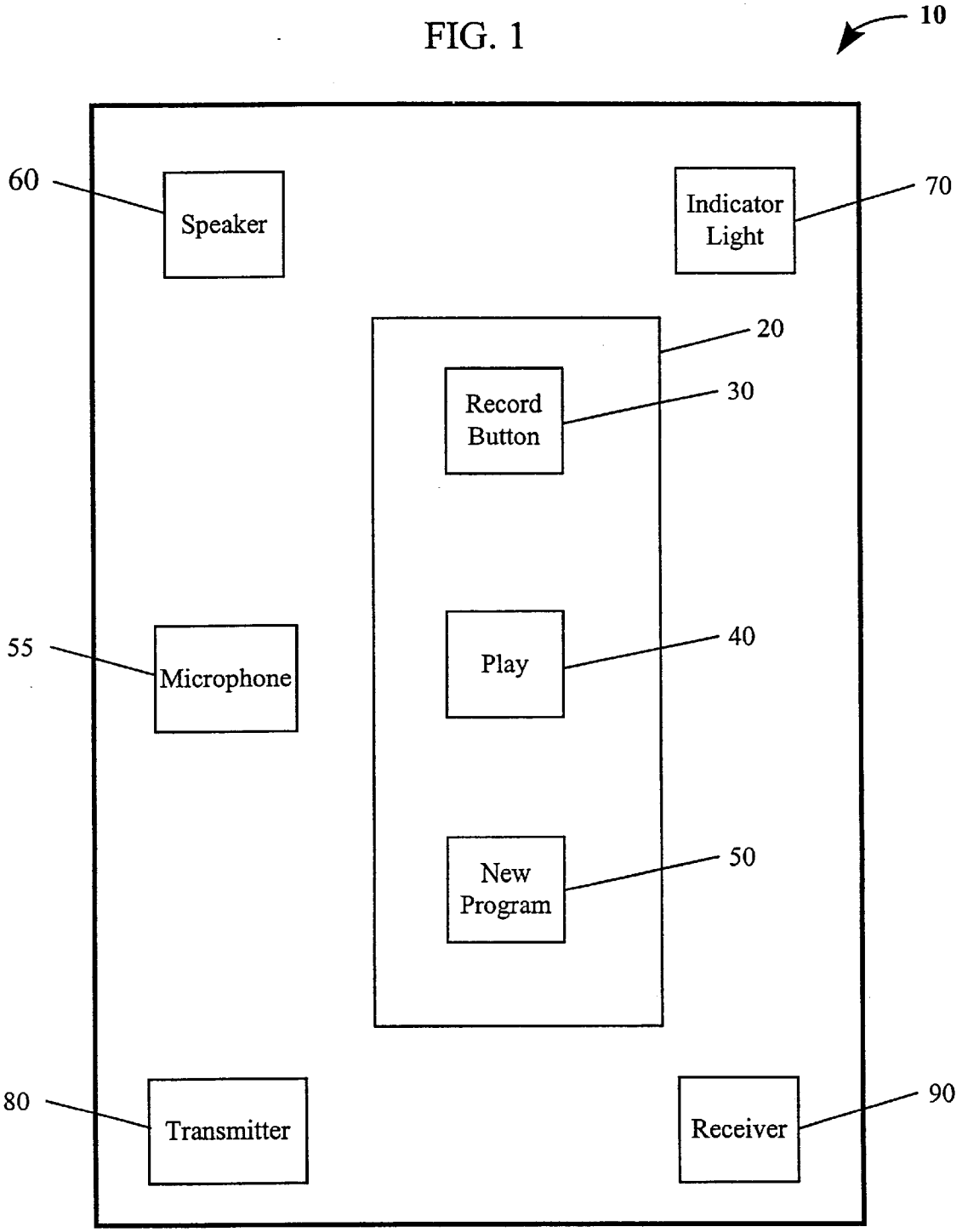
FIG. 1 is a depiction of the control panel of a toy constructed in accordance with the invention.

Reference is first made to FIG. 1 which depicts the control panel of a single unit constructed in accordance with the invention. As is shown in FIG. 1, a single unit constructed in accordance with the invention is indicated generally as 10, and further is formed with a control panel 20. Control Panel 20 is further formed with a record button 30, a play button 40, and a new program button 50. Also provided on other portions of unit 10 are a microphone 55, a speaker 60, an indicator light 70, an infrared, radio or other transmitter 80 and an infrared, radio, or other receiver 90.

Figures 1, 2A:
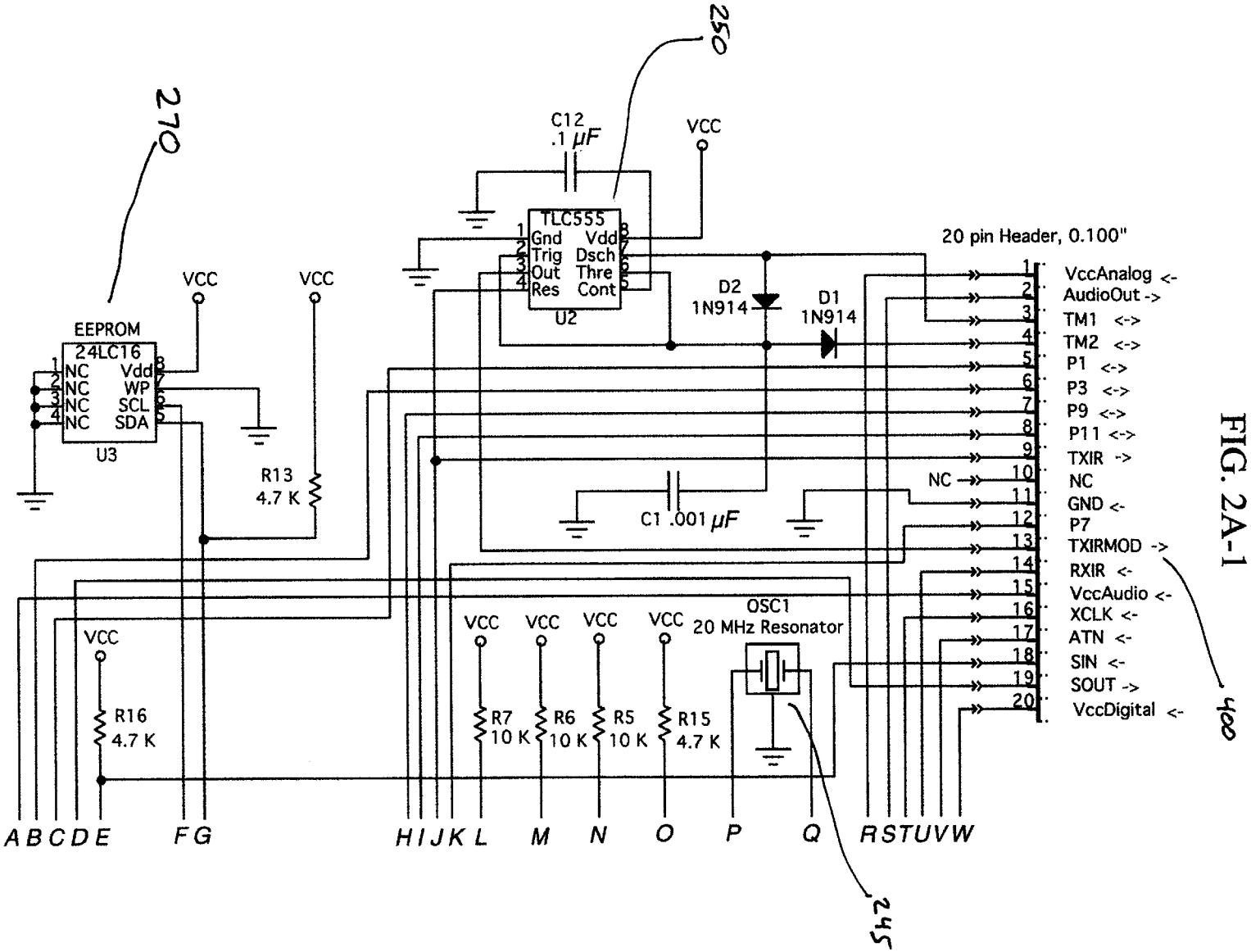
FIGS. 2A and 2B are a wiring diagram depicting the structure of the internal components of a toy constructed in accordance with an embodiment of the invention.
Figures 2, 2A:
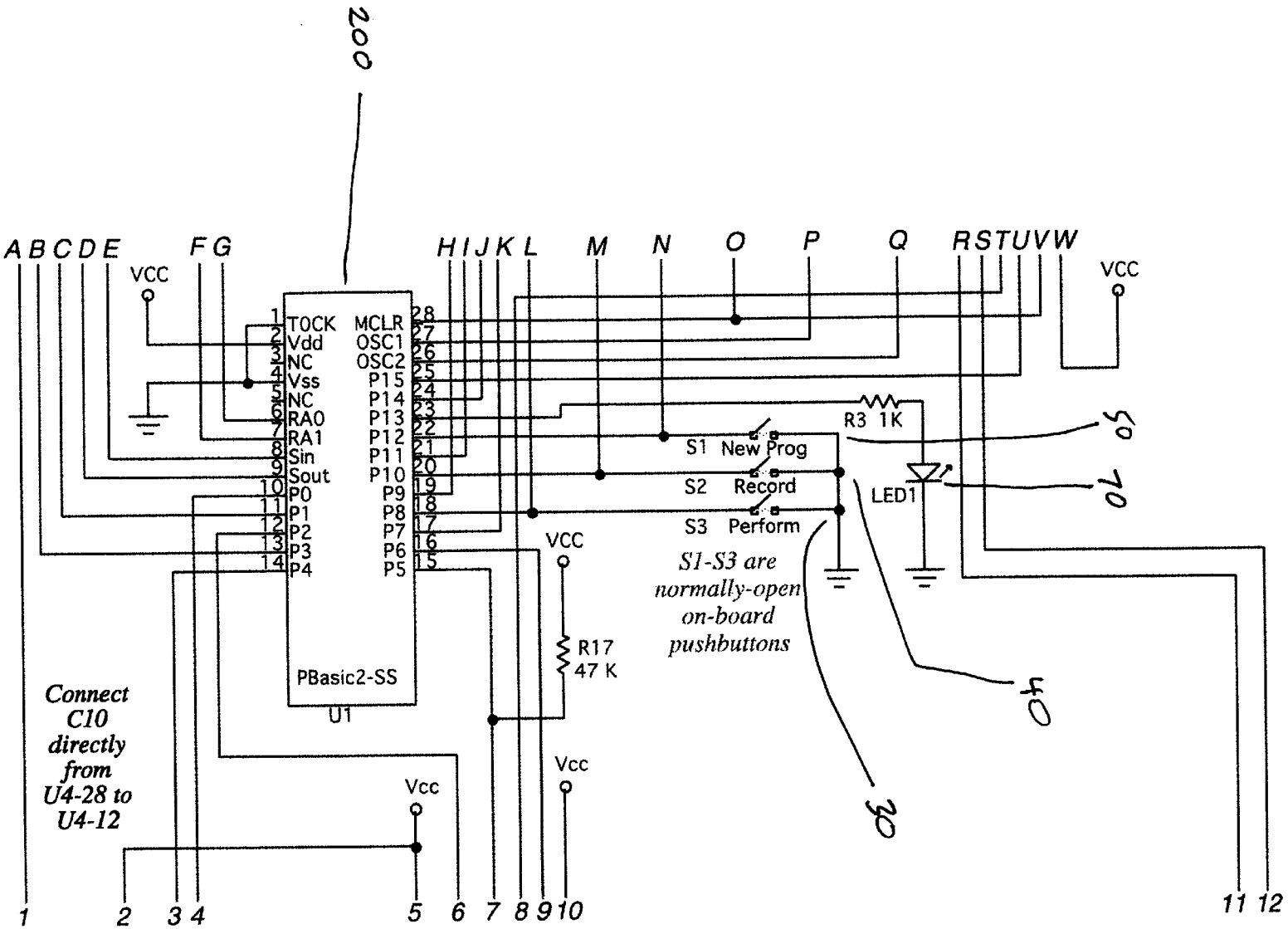
Figures 2, 2A, 3:
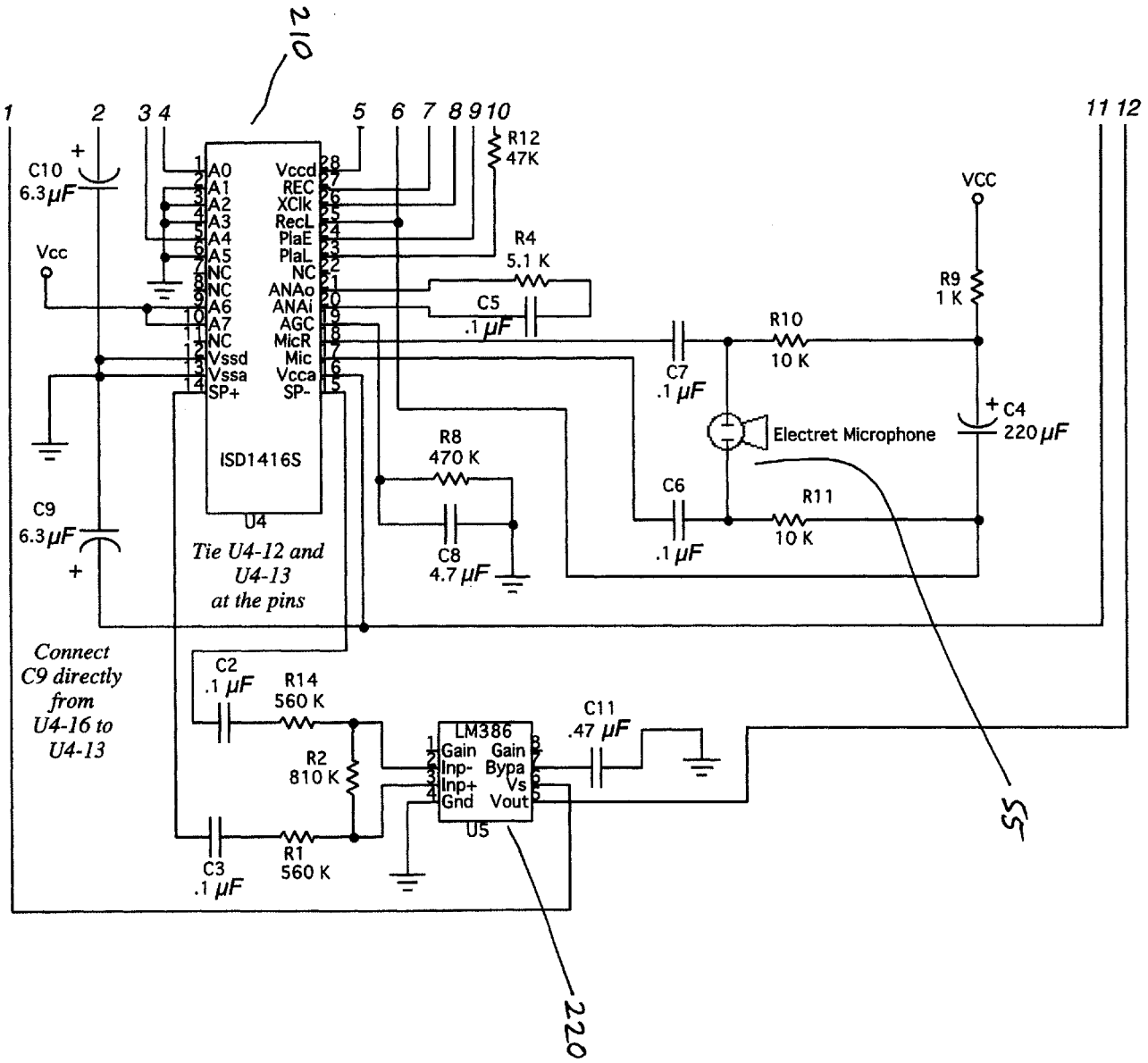
Figure 2B:
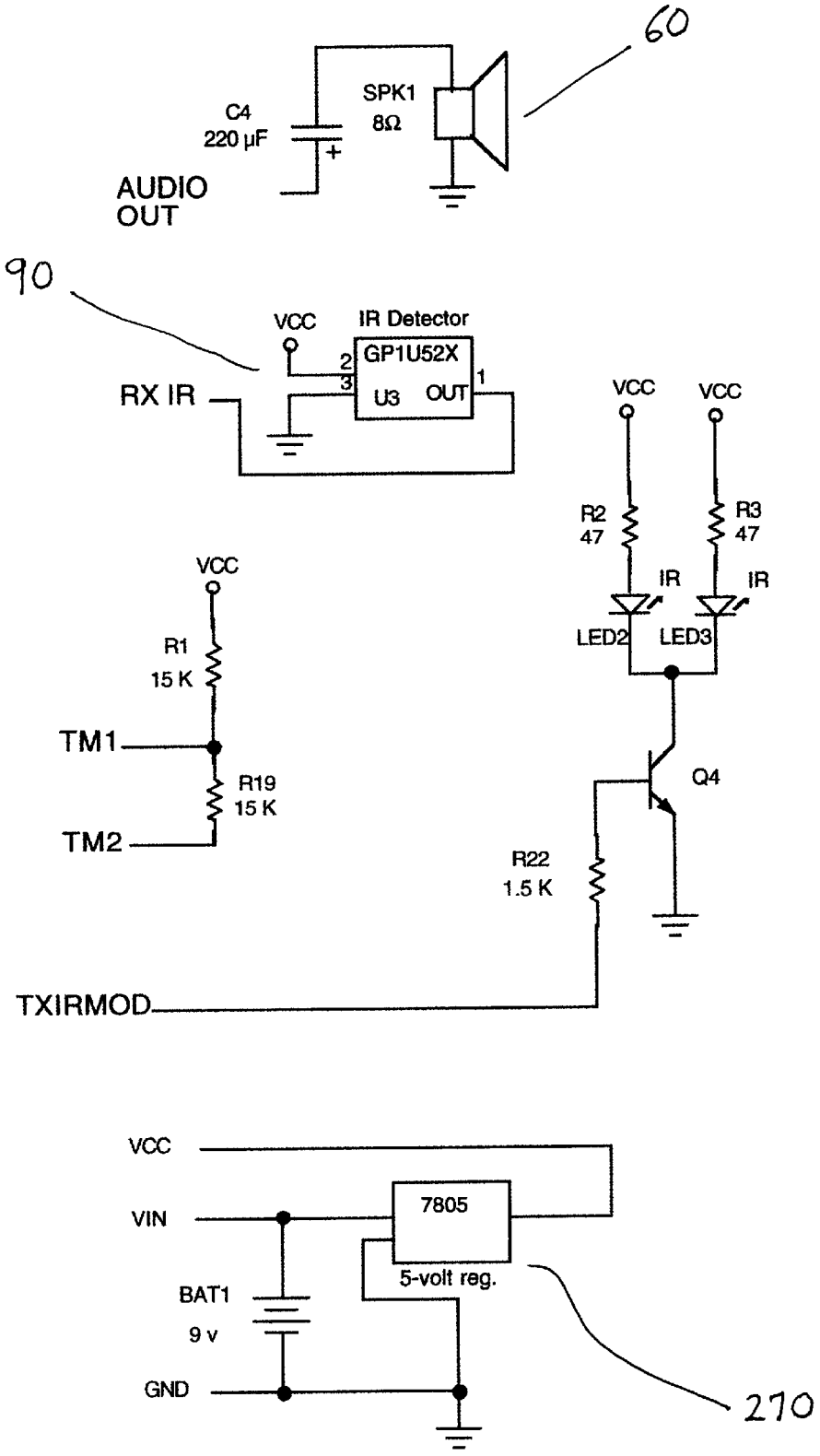

Reference is next made to FIGS. 2A and 2B, which depict the internal structure of an exemplary embodiment of the invention. It is possible to structure the internal portion of the invention in any number of similar manners which will allow the invention to function as desired. Additionally, the specific embodiment of the figure employs infrared communication. However, it will be recognized by the person of skill that is also possible to employ radio or other communication protocols. Radio communication will also be discussed below, since additional alternative features are also provided thereby. As is shown in FIGS. 2A and 2B, a microprocessor 200 is provided which carries out all of the commands and functioning of the unit. A sound control chip 210 is also provided, and is coupled with microprocessor 200. Sound control chip 210 may be a commercially available chip, such as an ISD1416S chip available from ISD, or other art recognized equivalent. Microprocessor 200 informs sound control chip 210 when to store and play sound, and when to perform any number of other functions through connections between the two chips. Sound control chip 210 is further connected to an audio amplifier 220, for outputting sound through speaker 60, and microphone 55, for receiving input sound.

An EEPROM memory chip 240 is provided and is coupled to microprocessor 200, for retaining the programming code which allows the apparatus to function. It is possible that adequate memory may be provided within microprocessor 200, and therefore, a separate EEPROM memory would not be necessary. Such circuit design details are a matter of choice for the routineer in the art, applying the teachings of the present invention. The instructions are clocked in and out of EEPROM memory 240 by a clock signal received from microprocessor 200 and generated by a clock oscillator 245.

Also provided in the infrared version of the apparatus is an infrared clock 250, which provides a pulsed signal to the standard infrared output of microprocessor 200, which is output on line TXIRMOD 400. By using such a modulated infrared output, as is standard in the art employed in remote devices such as remote controls for audio/video equipment and the like, background infrared noise is filtered out. This modulated infrared output comprises digital commands which are transmitted to all of the other units within range so that the actions can be coordinated between them.

As is further shown, speaker 60 and infrared receiver 90 are coupled to microprocessor 200. Finally, a voltage controller 270 is provided to insure proper voltage levels for the digital signals in the system, in accordance with art recognized principles.

It would also be possible to employ radio communication between each of the toy units in place of the infrared communications described above. The general structure of the internal structure of the toys would be identical, only the transmitter and receiver would be sensitive to radio waves rather than infrared radiation. This employment of radio communications allows for an additional feature that in addition to the transmission of start and end codes, actual speech could also be transmitted. For example, it would be possible to utilize a stereo transmission, one channel conveying commands, the second channel transmitting speech or other content. In this manner, it would be possible to preload a pre-stored series of events into any number of toys without speaking into, or teaching each individual toy. Therefore, this communication technique allows for an easier way to load pre-stored plays or stories to be acted out by the toys. Additionally, a plug-in wired communication method could also be used for communicating signals and sound of other information between the toys. The person of skill will recognize, utilizing the inventive concepts disclosed herein, that the precise communication methodology employed is a matter of design choice, depending on, among other factors, the type and quantity of events to be stored, the number of objects that can be included, the communication range desired, and the speed of intercommunication. Moreover, the particular details of such transmitter/receiver methodologies are readily comprehended by the person of skill, and need not be discussed or detailed herein.

Figure 3A:
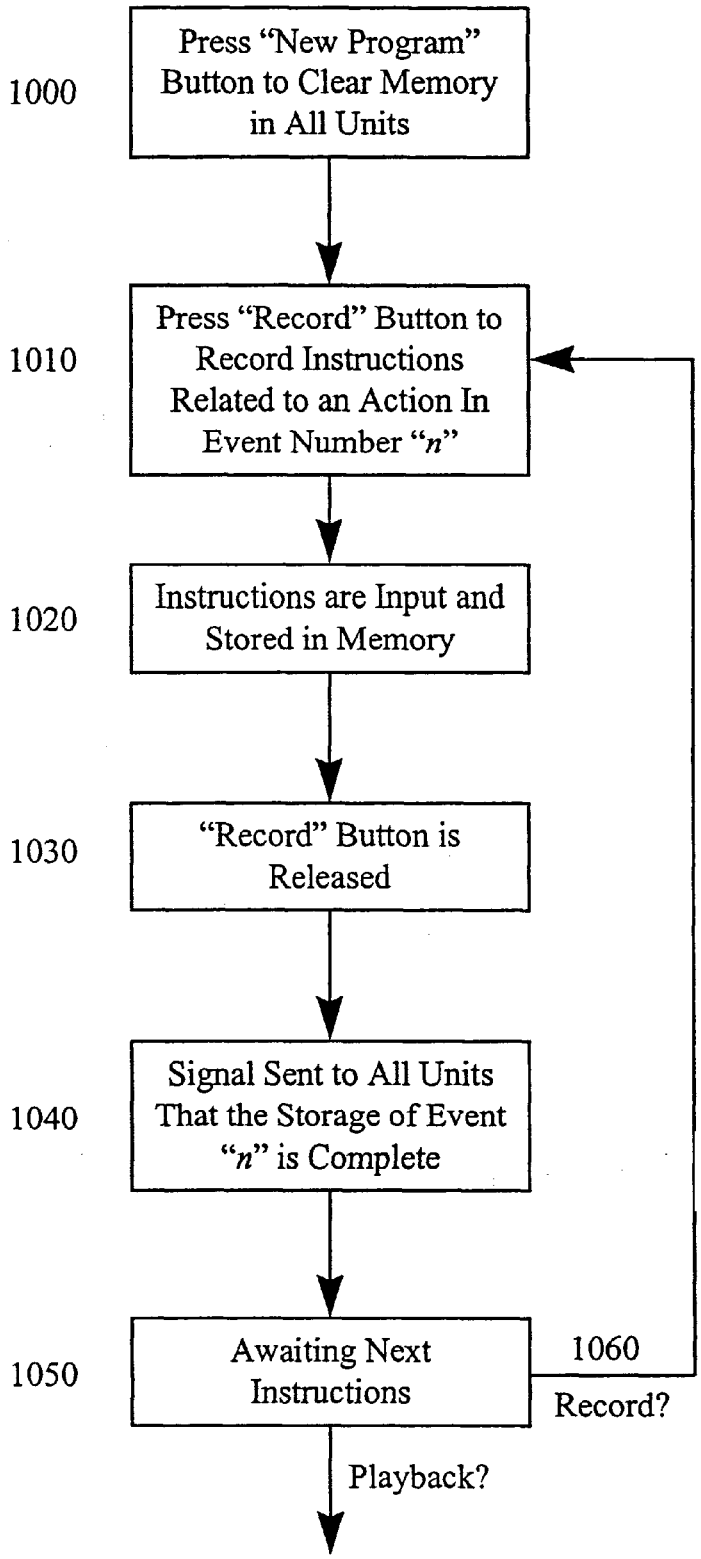
FIG. 3A is a flowchart depicting the end user's procedure for programming any number of toys in accordance with the invention.

Reference is next made to FIG. 3A, which depicts a flow chart of the steps necessary for programming a toy or group of toys. While this description will be given referring to a group of toys, it will be appreciated that this method of programming, and the following method of playback, will work equally well with only one toy present. To program the system, in step 1000, a user first clears the memory of the entire group of toys by pressing "New Program" button 50 on any one of the toys in the group. Indicator light 70 may light during the depression of any of the buttons to indicate to the user that the toy has recognized that the button has been depressed. The signal to clear memory is sent by infrared, radio or other transmission method, as discussed above, to all of the toys which are present and within the range of the signal. The signal is output from the toy on which the button is pressed, and is received by all of the other toys. Then, in step 1010, the user presses "Record" button 40 on the first toy (which may be any of the toys in the group) to store an event, comprising a sound or other action, in the toy. The event is only stored by the one toy which is being programmed by the user. When button 40 is pressed, microprocessor 200 informs sound control chip 210 to store the sound being input through microphone 55, in step 1020. If events other than sound are being input, such as motion or the like, this other event information will be stored at this time. When the storing is completed, the user releases "Record" button 40 in step 1030, and the storing of sound by sound control chip 210 is completed. Then the toy which was in use sends a signal to all of the other toys in step 1040 that the first event is complete. In step 1050, each toy awaits a further instruction.

In step 1060, it is determined whether "Record" button 40 has been depressed, indicating that a new event is to be stored. This additional event may be stored by any of the toys, and is maintained only in the one toy that is receiving the input event. After depression of the "Record" button, control switches to that toy, and the sequence returns to step 1010. The storing of events is done in the desired order of performance of the events by each toy.

Figure 3B:
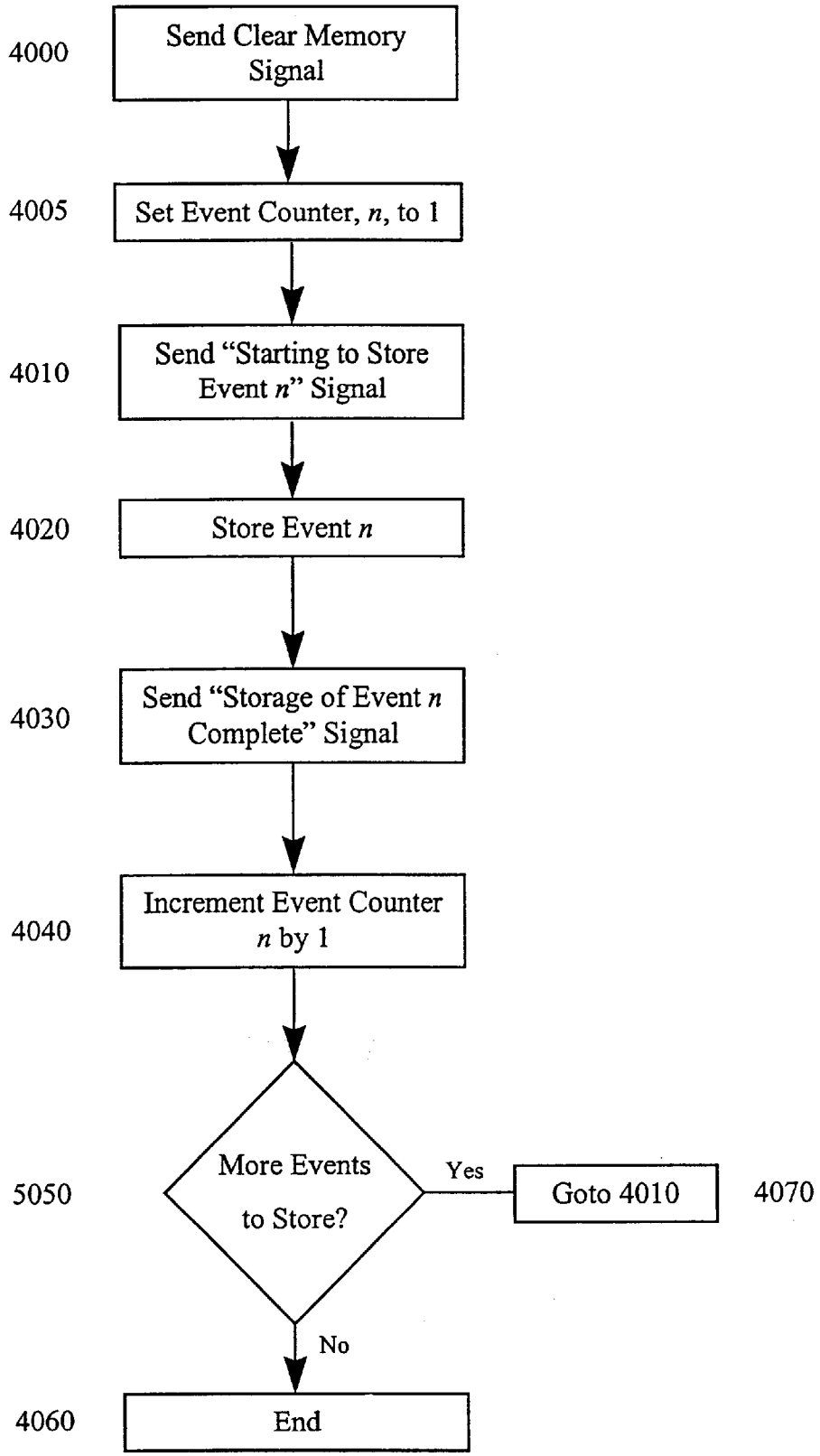
FIG. 3B is a flowchart depicting the procedure for incrementing a counter in a toy in accordance with the invention.

Reference is next made to FIG. 3B, which depicts how the event counter on each object is incremented by one. To program the system, in step 4000, a user first clears the memory of the entire group of toys by pressing "New Program" button 50 on any one of the toys in the group. The signal is output from the toy on which the button is pressed, and is received by all of the other toys. Each of the toys sets their counter to n. Then, in step 4010, the user presses "Record" button 40 on the first toy (which may be any of the toys in the group) to store event n, comprising a sound or other action, in the toy. The event is only stored by the one toy which is being programmed by the user. When button 40 is pressed, microprocessor 200 informs sound control chip 210 to store the sound being input through microphone 55, in step 1020. When the storing is completed, the user releases "Record" button 40 and the toy which was in use sends a signal to all of the other toys in step 4030 that the storing of event n is complete. Next, in step 4040, each toy increments their counters to n=n+1. In step 4050, each toy awaits a further instruction. If no further instructions are received, the storing of instructions is complete at step 4060.

In step 4070, it is determined whether "Record" button 40 has been depressed, indicating that a new event is to be .stored. This additional event may be stored by any of the toys, and is maintained only in the one toy that is receiving the input event. After depression of the "Record" button, control switches to that toy, and the sequence returns to step 4010. The storing of events is done in the desired order of performance of the events by each toy.

In an alternative embodiment, it is possible to provide additional functionality to allow for the reorganization of the elements after storing, or the insertion or deletion of an event from the sequence. Thus, the stored events could be moved, changed or otherwise acted upon by a user. Additionally, any other features, such as looping certain portions of the sequence, simultaneous playback of events by any number of the toys and the like might be provided for. Thus, through the simple sequence depicted in FIG. 3, it is possible to store a number of events in one or more toys. Additionally, as shown in FIG. 3B, each of the toys keeps track of the event numbers it is storing within the sequence of events, and only plays its particular event after the prior event, which may have been played by a different toy, has been completed. Therefore, no central controller is required, although one may be supplied if desired.

Thus, the sequence implemented in actual toys employing an infrared communication method would function as follows. During the programming phase, the toy being spoken into (or otherwise instructed) sends out status signals to the other toys in the group. For example, when the "Record" button is first pressed, a message is sent which means "Starting to store Event number 1." The sound capture then proceeds as long as the "Record" button is activated, with audio being stored into semiconductor memory in the circuitry of the toy being programmed. When the "Record" button is released, the toy sends an infrared message to other toys, meaning, "End of Event number 1." Since all of the toys present have received these start and end signals, and know that event number 1 is already in use and has been completed, they will tag the next storing as "Event number 2." While each toy is aware that event number 2 is to be stored next, only the toy which has stored event number 1 knows what event number 1 is, or even knows which toy has stored event number 1. In this way, as is preferable, each unit stores and remembers only the particular event(s) for which it is responsible at performance time.

Figure 4:
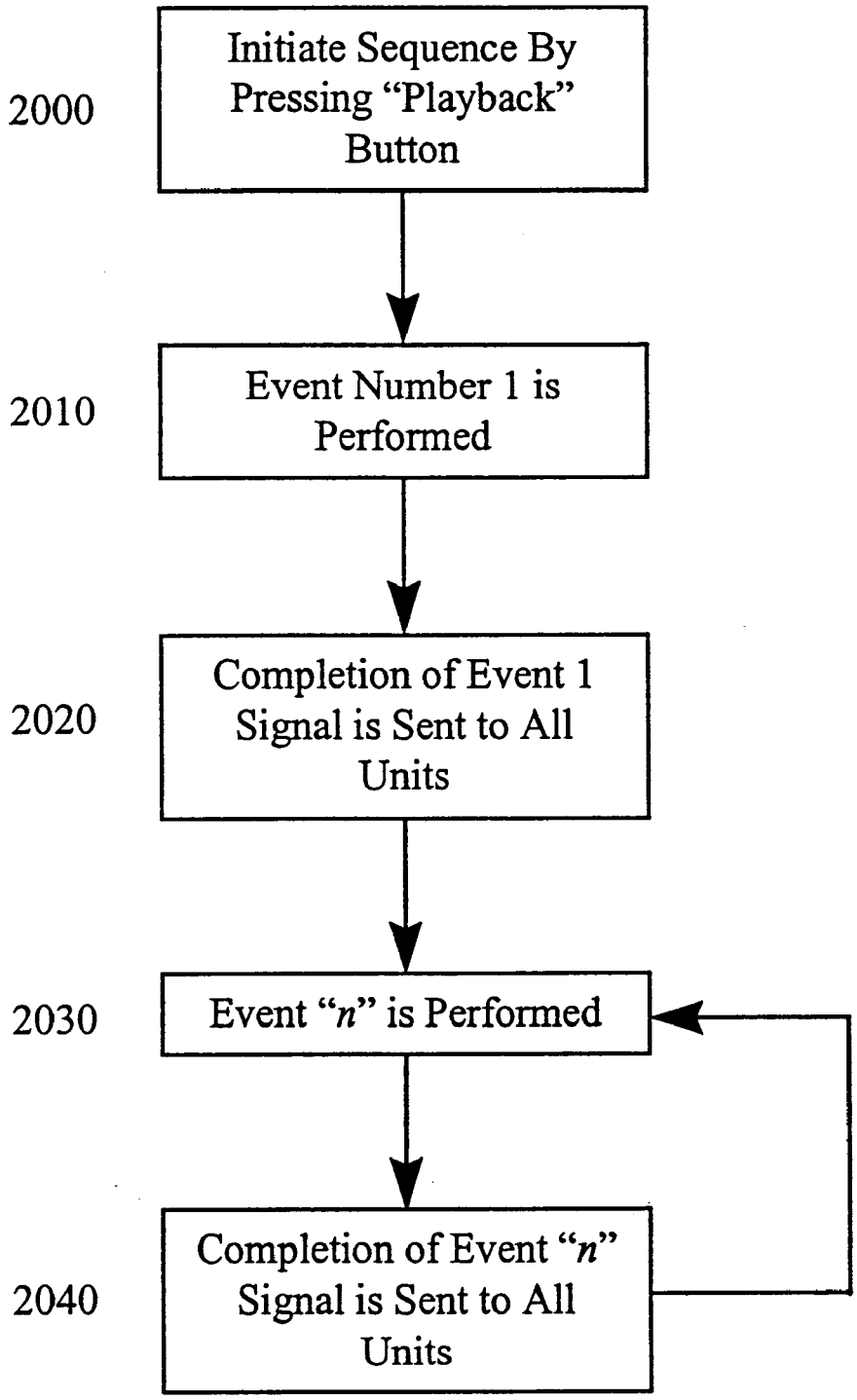
FIG. 4 is a flowchart depicting the procedure for playing back a sequence of events previously programmed into any number of toys in accordance with a first preferred embodiment of the invention.

As is next shown in FIG. 4, a simple sequence of steps allows for the playback of the sequence of events. The initiation of the playback sequence simply requires, at step 2000, for the user to depress "Playback" button 30 on one of any of the toys, or alternatively, a remote control unit for initiating the playback sequence could be employed. This initiates the playback sequence, and in step 2010, event 1 is played back by the toy in which the event was previously stored. In step 2020, a signal is sent to all of the toys within communication range indicating that event 1 has been completed. Next, in step 2030, event number "n" is played back, and in step 2040, a signal is sent to all of the units that event "n" has been completed. Then the next event is played in the sequence, as the sequence returns back to step 2030. Event "n" increments until the number of stored events is reached, whereupon all of the events are played back.

Thus, the sequence implemented in actual toys employing an infrared communication method would function as follows. To run a performance, the user presses the "Play" button on any one of the toys. This causes that toy's infrared transmitter to send a message meaning, "Proceed with Event number 1." Since all of the toys receive this message, the toy which is responsible for Event number 1 immediately plays back the appropriate stored sound or event, and then sends out an infrared message meaning, "Event 1 is Complete, Proceed with Event number 2, etc., until all stored events are played." In this way, each event (in this case, by way of non-limiting example, a stored sound) is performed at the appropriate point in the sequence. The group of toys is then ready either to perform the same sequence again, to add more sounds to the existing sequence, or to create a new sequence.

The entire set of toys retains a stored sequence indefinitely, even if batteries run down, so that a sequence can be replayed as many times as desired. An entirely new sequence, involving the same toys or a different combination of toys, can be created at any time.

In the simplest, lowest-cost implementation, only one sequence is stored at a time. Additional controls and longer sound memory will allow a group of toys to retain more than one program. With optional equipment (see below, example 4) it is possible to store entire performances onto standard audio cassette tape or other storage devices, using an audio-encoded version of event storing, for reloading into the set of toys when desired. This feature would also allow for pre-stored stories or plays to be loaded into a single or group of toys so that the story or play can be acted out by the toys.

Figure 5:
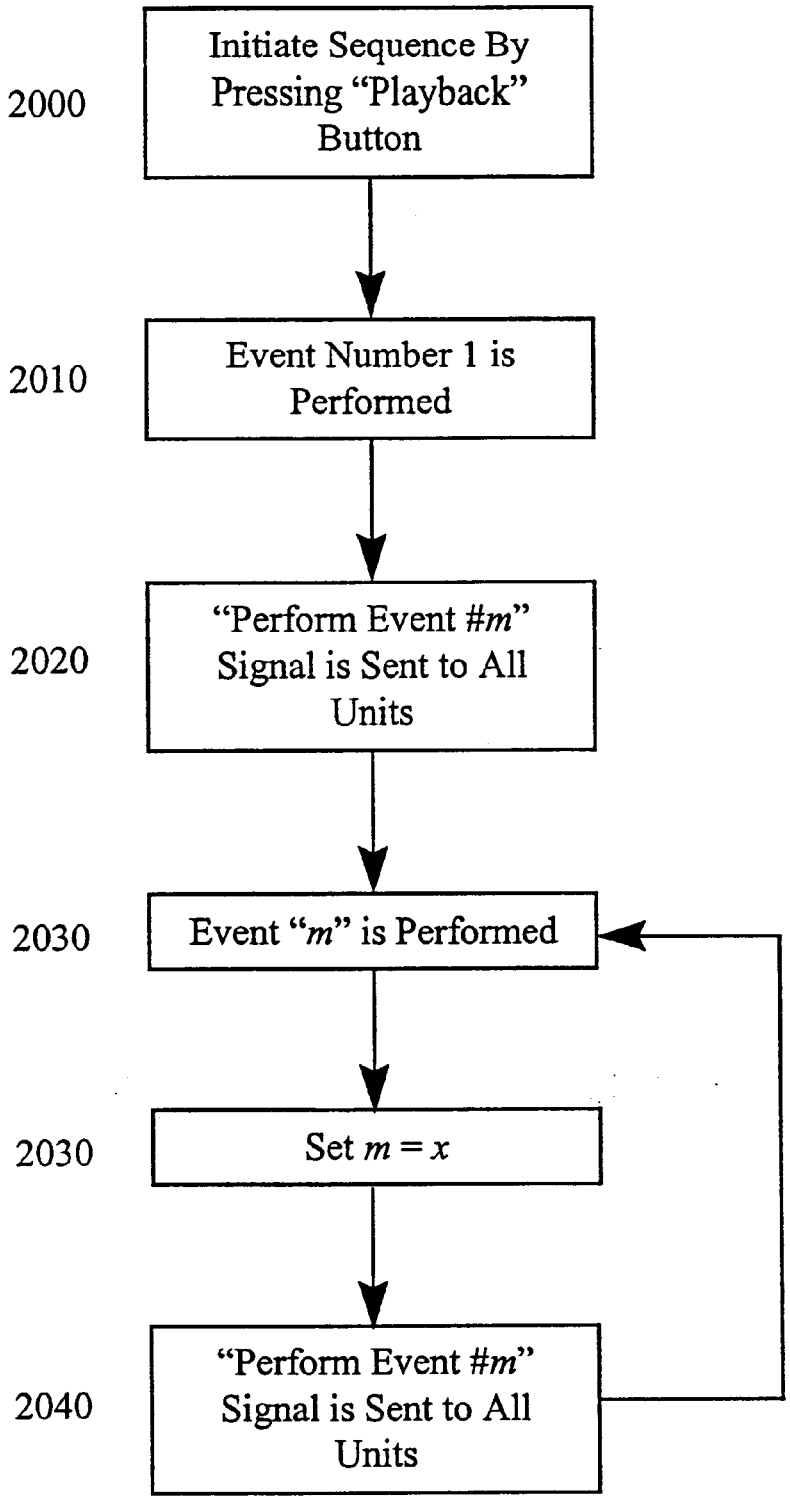
FIG. 5 is a flowchart depicting the procedure for playing back a sequence of events previously programmed into any number of toys in accordance with a second preferred embodiment of the invention.

In a second preferred embodiment, as shown in FIG. 5, the initiation of the playback sequence requires, at step 2000, for the user to depress "Playback" button 30 on one of any of the toys, or alternatively, a remote control unit for initiating the playback sequence could be employed. This initiates the playback sequence, and in step 2010, event 1 is played back by the toy in which the event was previously stored. In this embodiment, in step 2020, a signal is sent to all of the toys within communication range instructing them to "Perform event #m". Next, in step 2030, event number "m" is played back, and in step 2040, a signal is sent to all of the units instructing them to "Perform event #m+1". Then event m+1 is played, and the sequence returns back to step 2030. Event "m" starts at step 2 and continues to increase to the number of stored events until all of the events are played back.

In this embodiment, m may equal n+1, in which case the message is equivalent to the message in the first preferred embodiment. However, in this embodiment, m could equal any valid number or other art recognized digital coded alphanumeric string, designated x. If m is not equal to n+1, the message effectively performs a "goto", sometimes called a jump or branch. One skilled in the art will appreciate that the ability to perform a "goto" allows arbitrary flow-of-control constructs such as loops, conditional branches, multi-way "case" statements, subroutine calls using Boolean or small integer return values, as well as interrupts, Direct Memory Access (DMA) and the like. An event or action performed by one of the objects may consist of any electronically or photonically controllable change of state, including without limitation, mechanical motion, optical sensing, calculation, random number/event generation, sensor input and response, and so forth. That is, any internal or external action or change of state which the unit is capable of performing as specified by a stored program step. Further, an event performed by one object may influence the future flow-of-control either in program steps stored within that object (for example by changing a flag bit or other private data), or in program steps stored elsewhere in the plurality of objects, by means of a return code which is broadcast by one object and received by other objects.

Some of the unique features of a system constructed in accordance with this embodiment include the following: (1) only sequence related information (no arbitrary or event-related data) need be sent over the communications medium; (2) neither a single object nor a group of colluding objects can with certainty control or "understand" a system of cooperating objects within the network environment. Since the distinction between public (sequence) information and private (data or event related) information is narrowly and tightly defined, both object-level privacy and system-level security are significantly enhanced, and even in a sense guaranteed, as compared with conventional network-connected systems, and (3) interoperability between properly constructed objects can be permanently assured, regardless of the present or future capabilities of individual objects, as only sequence related information need remain standardized.

In a third preferred embodiment, instead of using an unbroken sequence of event numbers (1, 2, 3, . . .) the protocol is modified so that arbitrary event numbers or codes are used. For example, an arbitrary 32-bit integer might be used as an uninterpreted event "tag" (label), with the restriction that within any group of objects, each distinct event must be associated with a distinct event tag; that is, duplicate event tags are not allowed. Accordingly, a 32-bit integer derived from a pseudo-random sequence with a randomized starting point could be generated independently within each object whenever a new event was created. Each event tag would be broadcast in messages pertaining to the event with which it was associated. Since such event tags do not intrinsically convey information about their ordering, the actual 32-bit tag from the broadcast message would be stored in every object's memory for each event to which that object might later transfer control. At a minimum, this embodiment requires every object to store in its memory a 32-bit event tag for the event immediately following each event performed by that object, so that control can be transferred to the next object in sequence.

Since duplicate event numbers are prohibited, it is appropriate to point out that the probability of creating two identical 32-bit random event numbers within a group of 1,000 such random event numbers is approximately 1 in 10,000. That is, of 10,000 independently generated groups, each group containing 1,000 32-bit random event numbers, it is expected that only one of the 10,000 groups will have even a single duplicated event number. Since 1,000 events is larger than the expected typical number of events in use by a group of objects, the assumption of non-duplication is reasonable. Of course, the person of skill will recognize that if necessary, larger event numbers, e.g. 64 bits long, may be utilized, as a matter of design choice.

The specific advantages provided by this embodiment relate to synchronization of event number creation among various objects within a group. In the previous embodiments, event number creation is synchronized only by a "clear all events" message broadcast by one of the units. All receiving units then set an internal "next event number" counter to 1, and later increment this counter as events are created within that object and as event-creation broadcasts are received from other objects. For example, in the previous embodiments, if one of the objects is momentarily switched off or is out of range, and fails to receive the "clear all events" message, there will be a discrepancy among the "next event number" counters in the various objects. The counters can be re-synchronized as soon as an event creation message is broadcast by one of the objects whose counter is correct, but it is possible that the un-synchronized object will be called upon to create a new event number before any other object does so. There are several other similar or related situations in which event number creation can become un-synchronized, or in which separate groups of event numbers might be desirable. One example of the latter is a pre-programmed factory sequence involving two or more objects. The question becomes what event numbers should a fixed sequence use, and how (if at all) can they be intermixed with user-generated numbers. The system of arbitrary event numbers of this embodiment is capable of handling all such problems in a simple and unified way.

One potential drawback of this embodiment is that it adds to the memory capacity requirements of each object. Also, the time required to broadcast a 32-bit event number may be significant if the communication rate is low. For example, at 300 bits per second, more than 0.1 seconds is required to transmit a 32-bit event tag. A possible compromise embodiment involves a combination of sequential and non-sequential event numbers, with the sequential numbers being used whenever possible, or an increase in transmission speed.

In a fourth embodiment, the system is constructed with a fallback protocol. In the previous embodiments, during sequence playback a non-responding object could bring the entire sequence to a halt. This could occur because each object in turn is responsible for performing its own event(s) and then passing control to the next object. If a unit fails to respond to a broadcast signal, it may not fulfill either responsibility. Accordingly, in this embodiment, a simple addition to the operating software allows for detection of a non-responding object by the object that precedes it. In this embodiment, after an object has broadcast the appropriate signal to initiate playback of the next event, it remains active and monitors the situation, issuing additional broadcast signals if necessary, whereby control is accepted by either a desired next object or by some other object which controls events later in the sequence. To accomplish this requires only a relatively simple change in the operating software. For example, in this embodiment, the following messages are exchanged by the objects: After event #a is finished the object broadcasts <Do Event #a+1>. The object responsible for event #a+1 immediately broadcasts: <Event #a+1 is starting>. After event #a+1 is finished the object broadcasts <Do Event #a+2>. The object responsible for event #a+2 immediately broadcasts: <Event #a+2 is starting>, and so on. Since the message <Event #a is starting> is expected to be sent immediately, the preceding object can run a timer under program control, while listening for the desired message. If, within a set time, the <Event #a is starting> message is not received, the preceding object can take corrective measures, such as skipping that event and moving on to request successive events until another object responds.

It will be appreciated by one skilled in the art that a wide variety of features can be added to those described in the above preferred embodiments in order to enhance the functioning of the toys, including adding features of one embodiment to another embodiment. Some examples among many such additional features are as follows.

EXAMPLE 1

A simple remote control with more functions than the set of buttons described above allows editing of stored sequences. This unit can be, for example, very similar, both in appearance and in design, to the remote controls used for television sets. Its buttons include "Erase," "Review", "Rewind," "Combine," "Extend recording," and so forth.

EXAMPLE 2

A combination loudspeaker and infrared transmitter, which plugs into the headphone jack of a standard personal stereo product, can be provided to enable loading of an entire pre-recorded sequence of speech into a group of dolls automatically. Pre-recorded audio programs, using actual character voices, plus music and sound effects, can be made available for use with this device. These monaural audio materials contain, instead of a second stereo track, tone-encoded commands to be translated and sent via infrared to the ensemble of dolls. A factory-supplied identifier code in each doll will enable selection of the proper character to receive audio loading of each line of dialog. In such an embodiment, using radio transmission, it would be possible to send the required sound information with the radio command sequence. Therefore, a separate hard wired jack is not necessarily required, but the loading of the sounds would proceed similarly.

EXAMPLE 3

A device similar to that in Example 2 may be built into a small stage or home puppet theater, and may also be used during a performance. Thus, such a unit may add other effects, such as lighting changes, narration or music. This adds a significant element of "live" presence to characters previously seen only on TV, movies or computer games. Thus, full stories or other sequences could be acted out by the toys.

EXAMPLE 4

A somewhat more capable device will acquire and save an entire audio performance, as created by a home user, including both sound and sequencing information, onto ordinary audio cassette tape. The information could also be stored into computer memory or onto other computer storage media. This device is also provided with both a receiver and transmitter, as well as storing capability in the audio equipment so that all elements of a performance performed by a user may be stored by each of the appropriate units.

EXAMPLE 5

Beyond the reproduction of sound, a logical extension includes the storing of events including other actions such as movement of the character's mouth, arms, and so forth, as well as turning on and off small lights or other display devices as required by the stored performance. Such features can be incorporated into any new unit without causing incompatibility with preexisting units which lack that particular capability. Shape-memory alloys, such as Nitinol wire, might serve as inexpensive "muscles" for motion. In short, any electronically controllable object, toy or device can be incorporated into the invention described herein.

EXAMPLE 6

Some devices embodying the invention can also be provided which do not look like any sort of toy, but rather will be built into models such as a small speaker enclosure that might include a group of decorative lights. This model can be used for various household applications such as a doorbell with custom recorded sound, a wireless holiday light sequencer, a timed reminder with light and sound alarms, and a Halloween spook simulator, for example.

EXAMPLE 7

A group of products which crosses over from children's' toys to adult utility and entertainment also include a "Message Family" of generic or customized figures, representing Mother, Father, Sister, Brother, and so forth. These figures can store messages from each family member to the others. At the end of the day, the group of figures will contain a virtual conversation, which can be replayed in sequence, as described above.

EXAMPLE 8

Old toys can be incorporated into the inventive system by incorporating all or some of the features described above into portable "back packs" or modules that can be mounted or attached to a pre-existing toy or object, thus adding new play value to older toys. Alternatively, such modules can be swapped into newer toys via plug-in sockets to allow the exchanging of programs between toys or the saving of multiple preferred actions to be performed. Additionally, such modules may be factory pre-programmed.

Thus as described, the invention employs a number of key features. The invention includes a procedure or set of procedures or methods (which may be, but need not be, embodied in specified equipment and/or a specified communication protocol) for control, synchronization and sequencing of a series of one or more actions or events performed by or sensed by one or more electronic or other devices. A system using the invention is capable of satisfying, among many others, the following criteria:

1. No Central Controller

A central controller is not a required part of the system. Thus, each unit of the system may be similarly constructed, and the removal of any one unit will not effect the overall functioning of the system. However, a central controller may be used with or added to the system if desired for a particular application, without modifying the underlying system or other devices in any way.

2. Self-configuring Network

Devices may inter-cooperate in a group with other devices simply by being present and within the range of the infrared or radio signals being utilized. For example, in a wireless system, by being within range of direct or mediated communication with all of the other devices in the group, a new unit may participate in the sequencing. The new unit may communicate with the other devices during both the programming and operating phases of system operation, without any need for prior configuration or prior notification of any device that any other device or devices are participating or are being added to the inter-cooperation sequence.

3. All Devices Equivalent on the Network

As noted above, all devices may be (but need not be) identical, requiring no device addresses or distinctions of any kind, either fixed or temporary, between the devices. Thus, no specific designation of the devices are necessary, whether specified in hardware, generated in software, or provided by any other means. There is no required concept of a unit or station number or other such identifier, although such a station identifier, or a unit-type identifier, might be added to facilitate additional enhancements or features, such as allowing the proper toy to be selected when a pre-stored story or play is being loaded into memory of a plurality of devices.

4. Unlimited Number of Devices on the Network

An intrinsically unlimited number of devices, or a number of devices limited only by practical constraints such as physical spacing and transmission distance, may inter-cooperate in one system. As noted above, as long as a new unit can send and receive proper messages, it can be included in the sequencing.

5. Unlimited Number of Events

An intrinsically unlimited number of actions and/or events, or a number of actions and/or events limited only by the combined memory sizes of all participating devices, maybe incorporated into the system. Therefore, if the amount of memory is increased, the number of events stored by each unit can also be increased.

6. Each Device Contributes Memory and Processing Power

Every additional device added to a system of inter-cooperating devices contributes its own memory capacity and processing power to the overall capabilities of the distributed system. An additional inter-cooperating device creates essentially no demands on other devices' resources. Thus, this places no limit on the number of inter-cooperating devices which may be utilized.

7. Event Specifics are Private to Each Device

Any necessary information pertaining to the nature and details of each action or event controlled or sensed by the system may be (but need not be) stored only in the particular device which is to perform or mediate that action or event. No device in the system need know any (although it may, if desired in a particular implementation, know some or all) details about the actions or event(s) mediated by any other device. When a particular event is completed, a signal is sent to all of the devices that a particular event has been completed. Then whichever unit is to play the next event proceeds. Therefore, the content contained in each event is retained only in one particular unit, all of the other units being transparent to the actual content of the event.

8. Future Devices Can be Certified Compatible With All Previously Manufactured Devices New actions and events not contemplated at the time of manufacture of an existing device may be provided in new devices. These new devices will be capable of freely inter-cooperating with the older devices without any modification of either the newer or the older devices. This is because none of the individual units acts as a central controller. Rather, a particular unit functions only when it has the next event to play back. Therefore, it is irrelevant exactly what is to be played back. Thus, any new playback features can be utilized, as long as the event will begin after the last event has been completed, and will notify all of the other devices after the playback that the event has been completed. As a related consequence, an unlimited number of different device types, sharing only the basic system technology and communication method, may inter-cooperate without any modification or reprogramming whatsoever of any device. Therefore, the above-mentioned programming activities necessary to cause any group of devices to inter-cooperate can be utilized on any currently developed, or future developed products.

Thus, licensees may be required to agree to certification of 100% compatibility for each kind or variant of device they manufacture. This is to insure that any new device will inter-cooperate with the other devices. It would be possible to require any licensee to display a symbol indicating such compatibility on the packaging or directly on each kind of toy so licensed so that a potential purchaser can be guaranteed of the compatibility.

9. Additional Capabilities

Compatible devices may, but are not required to, be capable of storing and reproducing sounds, including without limitation speech sounds in any language; music; natural sounds; electronically created sounds; and theatrical sound effects. A device is not required to talk or make any sounds. Devices which perform other actions (turning on lights, performing various kinds of movement, and so forth) are both possible and desirable within the marketplace. Thus, units which performed events which did not involve speech, but which rather involved any type of controllable action would be possible.

10. Wireless Communication at Low Bit Rates

Devices may be, but need not be, physically separated, and linked only by a simple and inexpensive wired or wireless communication system, such as an infrared transmission system or a simple, unlicensed radio link. The use of a radio link would additionally allow the programming voice to be transmitted in the same transmission, while the infrared signal would normally require an additional microphone to accept the input sounds, as noted above. However, if a non-audio event were being stored, it would be possible to transmit this information equally well by infrared or radio.

11. Fast Interactive Operation Even at Low Bandwidth

The necessary communication between devices is capable of occurring quickly (less than one tenth second between successive actions or events) even at low bit rates (for example, 300 bits per second). Thus, the units can properly interact relatively quickly, even if the transfer rate is low, thus allowing the construction of the devices using less expensive components, although higher bit rates can be readily utilized.

12. Single Narrow Band Communication Channel

Each device is capable of communicating with every other device in a currently active group by means of a single, shared communication channel. Examples of such a channel include, but are not limited to:

A single, low power, narrow band frequency allocation in the radio spectrum, similar in bandwidth to the channel allocation for the transmission of Morse code or for communication with a remote-control (R/C) vehicle;

A single infrared channel, such as the infrared channel created between a typical television remote control and the television set;

A local area network connection, using existing protocols and equipment;

An ultrasonic signaling system;

A wired link using virtually any type of conductor(s);

A fiber-optic link.

13. No Carrier Sense or Multiplexing Capability Required in Equipment

The communication between devices is capable of taking place without the use of carrier sensing, synchronized time division multiplexing, or frequency division multiplexing, although such means are not excluded from use by any particular implementation. Thus, once again, the units may be constructed out of less expensive components, therefore allowing for the reduction in the final cost of the unit to consumers.

14. Programming by Example

Sequencing and timing of actions and events, including overlapped or simultaneous actions and events, may be, but need not be, specified entirely by using a technique named "Programming by example." In this method, during the programming phase each device is sequentially caused by the user (or by some other device) to perform or store the action or event which it is to control and/or monitor, in the same sequence in which the action or event is to take place during "playback" of the sequence. Thus, the manner in which the events are stored is the same manner in which they will be played back. As noted above, more complicated units may allow for the modification of these events: after they have been stored.

15. Simple Operation

The entire control panel for each unit of a conversational toy series for small children can consist of a small hidden microphone and as few as two momentary-contact push buttons. The two buttons can be Record and Play. Each press of the Record button enables an additional sound or phrase to be stored while the button is activated. A single press of the Play button triggers playback of the entire stored sequence, including all devices present. Both buttons are held down simultaneously to perform a Clear operation. (This saves buttons and also lessens the likelihood of issuing the Clear command by mistake.) More extensive controls, incorporating, for example, a new program or clear button, editing functions, and possibly involving the use of a remote control, may be included for the use of older children and for adults.

16. Fully Distributed Database of Events and Their Sequences

The distributed memory of the entire system collectively contains sequencing information for "playback" of each action or event at the desired moment within the sequence. Thus, as noted above, no single unit contains any more information than is necessary for it to play back its own events in the proper sequence with the other units.

17. Single Device May Operate Alone or May Work With Other Devices

A single device incorporating the technology of the invention can, without modification and without the use of its communication link or any external controller, independently sequence a number of actions and/or events (for instance, playback of spoken phrases) limited only by the memory size and event capabilities of that particular device. As a result, a toy based on this technology is playable alone, and need not necessarily be sold in pairs or groups, but without modification, can be operated in groups simply by being brought into communication with another compatible unit.

18. Additional Features Employable in the System

Create one command to start storing remotely, and another command to stop it. This can be used to download entire sequences to specific toys. This capability requires a unit identifier or character identifier code to be associated with each toy, so that, as noted above, if a story is being downloaded, the proper parts will be distributed to the proper characters.

Use of voice-operated switching (VOX), allowing the device to terminate storing on silence. Thus, no record button need be held down. When the microphone of a particular device hears a sound, the device will begin storing the event, and storing will end when the sound ends. The hardware of the unit must be to allow the microprocessor to monitor the sound input level. This enhancement will help avoid silences during storing, although such silences can also be eliminated digitally within the ISD or DSP chip.

Create conditional goto events, or conditional skipping of event groups, or simultaneous performance of events, if certain conditions are present. Therefore, it would be possible to have the event playback sequence proceed in different directions, based upon certain conditions, such as the number of units present, or other conditions which may be monitored by the units.

Use DTMF tones, etc., to create a telephone answering system, with voice mail capabilities. Thus, the storing capabilities would be activated upon the answering of a receiver, and the unit would operate similarly to a conventional answering machine. The use of additional units add more storing time.

Fallback protocol for non-responding units. Thus, if an event number were completed, and the next event did not start for a predetermined amount of time, the previous master would signal that the following event had been concluded, even when it had not. This will allow for the completion of the sequence if one of the units is removed, or if a malfunction takes place. If more than two such "Running" messages were missed, the prior unit will reassert control and possibly announce (premature) completion of the failed event. While the above adds complexity and creates the possibility of an erroneous takeover while the next event is running correctly and consumes additional power, such an added feature might improve the operation of the sequence and system when a large number of units are being operated together.

Add MIDI playback capabilities (various instruments) and MIDI download protocol.

Create a PC interface unit, attached to a serial port, for example, for inter-cooperation using the extensive capabilities of a computer to generate sound and images, and for connection to the Internet. Devices will then inter-cooperate in worldwide groups.

EXAMPLE OF A WORKING PROTOCOL

The following exemplary protocol embodies many of the above-described features, and allows the system described above to operate as described. It is neither necessary nor preferred as an implementation of the invention, and serves only as an exemplary embodiment, which discloses a specific software embodiment. The comments included in the program operate as an algorithm which may be transferred to other programming languages, as well as a description of the function of the program to one skilled in the art. Thus, to one skilled in the art, the application of the included algorithm to the system described above will be known.

Protocol Example Description

Notation:

<message>

{event}

| Button pressed or situation | Local Action | Send Message | Notes |
|---|---|---|---|
| NEW PROGRAM button | Flash panel LED (after confirmation delay); clear all local event variables. | <Clear All Events> | Clean slate to all units |
| RECORD SOUND button | Start recording; LED on during recording; press again to stop recording. | On Start: <Open Event #n> (generate next n = 1, 2 . . . ) | Start: allows other units to add a chorus event. |
| | On Stop: save Event #1 for this unit, as master | On Stop: <Close Event #n> | Stop: tells others that Event #n is used up and Event #n + 1 is next for creation. A more general set of buttons (Open Event, etc.) will make chorus event cretion easier. |
| ERASE SOUND button | LED flash (after confirmation delay); "rewind" ISD chip | <Cancel Event #n> | Tells other units to delete any chorus event #n. |

-continued

| Button pressed or situation | Local Action | Send Message | Notes |
|---|---|---|---|
| | to start of last message; delete last event. | | |
| REVIEW SOUND button | Play last sound in local list. | (none) | Only used for local editing; no network consequences. |
| LOOP PROGRAM button | Record <Goto Event #1> as next event for this unit (must be master; cannot be entered as a chorus event) | (none) | Later might allow goto with other targets by referring back to some sort of log of event numbers, perhaps maintained on a PC or a remote control unit. |
| PERFORM PROGRAM button | Run Event #1 if it is local. | <Event #0 completed> (repeat at fixed interval (500 m sec delay while listening) until another message is received or 10 seconds elapses. | The user command to Perform Program constitutes Event #0; "real" event numbers start at 1. |
| A local event has been completed | If Event #n + 1 is saved on this unit, perform Event #n + 1 | <Event #n Completed> | Tell other units to perform Event #n + 1 if any |
| A <Goto n> event is processed | If this unit is master of Event #n, perform Event #n | Send a <Goto Event #n> message. | Send the message even if this unit is master of that event. The other units might need to know that a Goto has occurred. |
| <Clear All Events> | Clear all event variables. | (none) | |
| <Open Event #n> | Enable local Chorus Event #n programming by user. | (none) | |
| <Close Event #n> | Disable local Chorus Event #n programming by user; update Final Event variable to n. | (none) | Final Event variable, maintained by all units, stores the highest event number in the current program. |
| <Cancel Event #n> | Delete local Chorus Event #n, if any; set Final Event variable back to n − 1. | (none) | |
| <Event #n Starting> | If this unit was master of Event #n − 1, stop sending "Event #n − 1 Completed" messages, and cease time out monitoring. | (none) | An event master must relinquish control after receiving following "Event #n Starting", because it has no way of knowing how long that event will take to complete, so time out monitoring is not possible. |
| <Event #n completed> (n = 0, 1, 2 . . . ) | Run Event #n + 1 if it is local. | <Event #n + 1 Starting> (if this unit is master of that event number) | Tells previous unit that control has been taken. |
| <Clear All Events> | 11101100 (prologL)<br>0cccccccc (channelL)<br>00000000 (msgtype)<br>0kkkkkkk(checksumL)<br>0kkkkkkk(checksumH)<br><br>Brief version of message format:<br><br>prologL<br>channelL<br>msgtype (00000000)<br>checksumL<br>checksumH | prologL is 11101100<br><br>chanL channel number Default for channel number is 0. Units must ignore messages for channels not known to them.<br><br>msg type is the 7-bit code that identifies the kind of message (range = 0 . . . 128). Units must ignore message types not known to them. | prolog is a fixed 16-bit identifier word which identifies this as a Voca ™ message.<br><br>The checksum is calculated as follows: start with a 16-bit checksum variable set to zero. Exclusive-OR each message byte with 11010011 and add the 8-bit result to the checksum |

-continued

| Button pressed or situation | Local Action | Send Message | Notes |
|---|---|---|---|
| | | checksumL and checksumH are the low and high bytes, respectively, of the unsigned 16-bit sum of all prior bytes in the message after exclusive-OR-ing each byte with 11010011, discarding carries out of bit 15, and finally setting bit 7 of each byte to 0. | variable, using 16-bit unsigned arithmetic. After all message bytes have been accumulated, AND each result byte with 01111111 to set its high-order bit to 0. |
| <Open Event #n> (n = 1, 2, 3 . . . ) | 11101100 (prologL) 0cccccccc (channelL) 00000001 (msgtype) 0eeeeeee (eventnumL) 0eeeeeee (eventnumH) 0kkkkkkk(checksumL) 0kkkkkkk (checksumH) Brief version of message format: prologL channelL msgtype (00000001) eventnumL eventnumH checksumL checksumH | See above, with eventnumL and eventnumH the low and high 7 bits, respectively, of the 14-bit event number (range = 0 . . . 16,384). | |
| <Close Event #n> (n = 1, 2, 3 . . . ) | prologL channelL msgtype (00000010) eventnumL eventnumH checksumL checksumH | See above. | |
| <Cancel Event #n> (n = 1, 2, 3 . . . ) | prologL channelL msgtype (00000011) eventnumL eventnumH checksumL checksumH | See above. | |
| <Event #n Starting> (n = 1, 2, 3 . . . ) | prologL channelL msgtype (00000100) eventnumL eventnumH checksumL checksumH | See above. | |
| <Event #n completed> (n = 0, 1, 2 . . . ) | prologL channelL msgtype (00000101) eventnumL eventnumH checksumL checksumH | See above. | |
| <Goto Event #n> (n = 1, 2, 3 . . . ) | prologL channelL msgtype (00000110) eventnumL eventnumH checksumL checksumH | See above. | |
| <Vendor-Defined Message> | 11101100 (prologL) 0cccccccc (channelL) 00000111 (msgtype) 0uuuuuuu (vendornumL) 0uuuuuuu | vendor num is the user number, a unique 14-bit number assigned by [manufactured] to any vendor (or individual) who wishes to create a | To avoid conflict with other vendor-defined messages, send email to [vendor address] to receive a free, unique vendor number. Please |

-continued

| Button pressed or situation | Local Action | Send Message | Notes |
|---|---|---|---|
| | (vendornumH)<br>0nnnnnnn (bytecount)<br>. . . vendor-defined bytes . . .<br>0kkkkkkk(checksumL)<br>0kkkkkkk (checksumH)<br><br>Brief version of message format:<br><br>prologL<br>channelL<br>msgtype (00000111)<br>usernumL<br>usernumH<br>bytecount<br>. . . vendor-defined bytes . . .<br>checksumL<br>checksumH | custom Voca ™ message type.<br><br>Byte count(0 . . . 127) is the number of bytes in the message, including all bytes from prologL through checksumH.<br><br>It is suggested that all vendor-defined messages be kept as short as possible to avoid excessive delays and increased probability of transmission errors. | include your name, address, phone number, company name if any, and an email address.<br><br>Transmit vendor-defined messages using only your own vendor number, except in the case of public, documented vendor-defined messages.<br><br>Ignore vendor-defined messages with vendor numbers not known to your system. |
| All other message types are reserved by Voca ™ for future use. | Message types 00001000 through 11111111 are reserved. | For compatibility with future releases, do not create or use any reserved message types.<br><br>Ignore all message types not known to your system. | For custom message content, obtain a unique vendor number from Voca ™ at no charge. You can then create as many message types as you need by placing your own codes into the vendor-defined message format. |

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

What is claimed is:

1. A method of managing a plurality of controllable objects in the storage and execution of instructions related to a performance of n desired actions, the method comprising the steps of:

(a) advising said plurality of objects that a first selected object is about to store instructions related to a performance of a first desired action;

(b) storing, in said first object, said instructions related to said performance of said first desired action;

(c) advising said plurality of objects that said storing of said instructions in said first selected object has been completed;

(d) preparing said plurality of objects to receive instructions related to a performance of a next desired action;

(e) storing, in a next selected object, said instructions related to said performance of said next desired action;

(f) advising said plurality of objects that said storing of said instructions in said next selected object has been completed; and (g) repeating steps (d) through (f) until instructions related to said performance of said n desired actions have been stored.

2. The method according to claim 1, further comprising the step of advising said plurality of objects to begin executing said instructions related to said n desired actions.

3. The method according to claim 2, wherein said performance of said n desired actions is carried out by the further steps of:

(i) causing each object of said plurality of objects to individually determine whether it is the object that has stored said instructions related to said performance of said first desired action;

(ii) causing said object determined in step (i) to perform said first desired action by executing said instructions related to said first desired action;

(iii) causing said object determined in step (i) to advise said plurality of objects that said performance of said first desired action has been completed;

(iv) causing each object of said plurality of objects to individually determine whether it is the object that has stored said instructions related to said performance of said next desired action;

(v) causing the object determined in step (iv) to perform said next desired action by executing said instructions related to said next desired action;

(vi) causing the object determined in step (iv) to advise said plurality of objects that said performance of said next desired action has been completed; and (vii) repeating steps (iv) through (vi) until said n desired actions have been performed.

4. A system for managing a plurality of controllable objects in the storage and execution of instructions related to a performance of n desired actions, the system comprising:

advising means for advising said plurality of objects that a first object is about to store instructions related to a performance of a first desired action;

storing means for storing, in said first object, said instructions related to said performance of said first desired action;

second advising means for advising said plurality of objects that said storing of said instructions in said first object has been completed;

preparation means for preparing each object of said plurality to prepare to receive instructions related to a performance of a next desired action;

second storing means for storing, in a next object, said instructions related to said performance of said next desired action;

third advising means for advising said plurality of objects that said storing of said instructions in said next object has been completed; and repetition means for further activating said preparation means, said second storing means and said third advising means until instructions related to said performance of said n desired actions have been stored.

5. The system according to claim 4, further comprising instructing means for instructing said plurality of objects to begin performing said n desired actions.

6. The system according to claim 5, further comprising:

determining means for causing each object of said plurality of objects to individually determine whether it is the object which has stored said instructions related to said performance of said first desired action;

performance means for causing said object determined by said determining means to perform said first desired action by executing said instructions related to said first desired action;

fourth advising means for causing said object determined by said determining means to advise said plurality of objects that said performance of said first desired action has been completed;

second determining means for causing each object of said plurality of objects to individually determine whether it is the object which has stored said instructions related to said performance of said next desired action;

second performance means for causing said object determined by said second determining means to perform said next desired action by executing the said instructions related to said next desired action;

fifth advising means for causing said object determined by said second determining means to advise said plurality of objects that said performance of said next desired action has been completed; and second repetition means for further activating said second determining means, said second performance means and said fifth advising means until said n desired actions have been performed.

7. The method according to claim 1, further comprising the step of instructing said plurality of objects to erase any previously stored instructions.

8. The method according to claim 3, further comprising the step of instructing said plurality of objects to erase all stored instructions related to said performance of said n desired actions.

9. The system according to claim 4, further comprising an advising means for advising said plurality of objects to erase any previously stored instructions.

10. The system according to claim 6, further comprising an advising means for advising said plurality of objects to erase all stored instructions related to said performance of said n desired actions.

11. The method according to claim 1, further comprising the step of illuminating an indicator light in any one of steps (a) through (f).

12. The method according to claim 3, further comprising the step of illuminating an indicator light in any one of steps (i) through (vi).

13. The system according to claim 4 further comprising an indicator means for indicating that any of one said advising, storing or preparation means are in use.

14. The system according to claim 6 further comprising an indicator means for indicating that any one of said determining, performance or advising means are in use.

15. The method according to claim 1 further comprising the step of editing any of said stored instructions.

16. The system according to claim 4 further comprising an editing means for editing any of said stored instructions.

17. The method according to claim 15 wherein said editing is performed by a remote control unit.

18. The system of claim 16 wherein said editing means is a remote control unit.

19. The method according to claim 1 wherein any of said instructions are pre-recorded.

20. The method according to claim 19 wherein an external source is used to store said pre-recorded instructions on any one of said objects.

21. The method according to claim 20 wherein said pre-recorded instructions comprise an instruction with a unique identifier code to be stored in an object with a corresponding identifier code.

22. The method according to claim 21 wherein said corresponding identifier code is input by a toy user.

23. The method according to claim 21 wherein said corresponding identifier code is pre-programmed into an object.

24. The system according to claim 4 wherein any of said instructions are pre-recorded.

25. The system according to claim 24 wherein any one of said storing means receive said pre-recorded instructions from an external source.

26. The system according to claim 25 wherein said pre-recorded instructions comprise an instruction with a unique identifier code to be stored in an object with a corresponding identifier code.

27. The system according to claim 26 wherein said corresponding identifier code is input by a toy user.

28. The system according to claim 27 wherein said corresponding identifier code is pre-programmed into an object.

29. The method according to claim 1, wherein said steps (a), (c), (d) and (f) are effectuated via narrow band radio communication.

30. The method according to claim 1, wherein said steps (a), (c), (d) and (f) are effectuated via infrared communication.

31. The method according to claim 1, wherein said steps (a), (c), (d) and (f) are effectuated via a Local Area Network.

32. The method according to claim 1, wherein said steps (a), (c), (d) and (f) are effectuated via an ultrasonic signal.

33. The method according to claim 1, wherein said steps (a), (c), (d) and (f) are effectuated via a wired communication link.

34. The method according to claim 1, wherein said steps (a), (c), (d) and (f) are effectuated via a fiber optic communication link.

35. The method according to claim 1 wherein a Voice Activated System is used for said storing steps.

36. The method according to claim 3, further comprising the step of causing said object determined in step (iv) to advise said plurality of said objects that said performance of said next desired action has been started.

37. The method according to claim 36, further comprising the step of causing said object determined in step (i) to advise said plurality of objects that said performance of said next desired action has been completed if said object determined in step (iv) fails to advise said plurality of said objects that said performance of said next desired action has been started.

38. The method according to claim 36, further comprising the step of causing said object determined in step (iv) to advise said plurality of objects that said performance of said next desired action has been completed if said object determined in a repetition of step (iv) fails to advise said plurality of said objects that said performance of said next desired action has been started.

39. The system according to claim 6, further comprising a sixth advising means for causing said object determined by said second determining means to advise said plurality of objects that performance of said next desired action has begun.

40. The system according to claim 39, further comprising a fallback means for causing said object determined by said determining means to advise said plurality of objects that performance of said next desired action has been completed if said sixth advising means fails to advise said plurality of objects that performance of said next desired action has begun after a predetermined period of time.

41. The method according to claim 2, wherein said performance of said n desired actions is carried out by the further steps of:

(i) causing each object of said plurality of objects to individually determine whether it is the object that has stored said instructions related to said performance of said first desired action;

(ii) causing said object determined in step (i) to perform said first desired action by executing said instructions related to said first desired action;

(iii) causing said object determined in step (i) to advise said plurality of objects to perform a next desired action by executing instructions related to said next desired action;

(iv) causing each object of said plurality of objects to individually determine whether it is the object that has stored said instructions related to said performance of said next desired action;

(v) causing the object determined in step (iv) to perform said next desired action by executing said instructions related to said next desired action;

(vi) causing the object determined in step (iv) to advise said plurality of objects to perform a next desired action by executing instructions related to said next desired action; and (vii) repeating steps (iv) through (vi) until said n desired actions have been performed.

42. The method according to claim 41, wherein execution of said instructions related to performance of said n desired actions occurs in an order different from the order in which said instructions were stored.

43. A programmable object capable of intercommunicating with other programmable objects to perform a series of desired actions, comprising:

transmitting means for transmitting signals to be received by said other objects;

receiving means for receiving signals transmitted by said other objects;

storage means for storing a set of instructions related to a performance by said object of a desired action of said series of desired actions;

assigning means for assigning a unique event code to each set of instructions stored so that each desired action is represented by said assigned event code, said event code being stored in said storage means;

tracking means, in communication with said assigning means, for tracking said unique event code so as to permit said object to track which desired action of said series of desired actions is stored in said object;

commencement means, in communication with said transmitting means, for causing said transmitting means to transmit a first advisory signal indicative of the commencement of the storing of said event-coded instruction set in said storage means and to transmit a second advisory signal indicative of the completion of the storing of said event-coded set of instructions;

interpreting means, in communication with said receiving means, said assignment means and said tracking means, for interpreting advisory signals received by said receiving means so as to permit said object to track whether said other objects have stored an other event-coded set of instructions and to track what event codes have been assigned to those other objects, so that said assignment means can determine a next available event code for assignment;

executing means for executing said event-coded set of instructions; and playback means, in communication with said transmitting means, for causing said transmitting means to transmit a playback signal, said playback signal causing said object and said other objects receiving said playback signal to execute all stored event-coded sets of instructions in event-coded order, so as to cause the performance of all desired actions in said series of actions.

44. The apparatus of claim 43, further comprising:

determining means, responsive to said playback signal and in communication with said tracking means, for determining which desired action in said series of actions is the next to be performed;

second determining means, responsive to said playback signal and in communication with said tracking means, for determining if said object has stored an event-coded instruction set corresponding to said next action to be performed; and instructing means for instructing said executing means to execute said event-coded instruction set corresponding to said next action.

45. The apparatus according to claim 44, further comprising:

second commencement means, in communication with said transmitting means, for causing said transmitting means to transmit a third advisory signal indicative of the commencement of the execution of an event-coded instruction set; and completion means, in communication with said transmitting means, for causing said transmitting means to transmit a fourth advisory signal indicative of the completion of the execution of an event-coded instruction set.

46. The apparatus according to claim 45, wherein said transmitting means and said receiving means utilize narrow band radio communication.

47. The apparatus according to claim 45, wherein said transmitting means and said receiving means utilize infrared communication.

48. The apparatus according to claim 45, wherein said transmitting means and said receiving means utilize a Local Area Network.

49. The apparatus according to claim 45, wherein said transmitting means and said receiving means utilize an ultrasonic signal.

50. The apparatus according to claim 45, wherein said transmitting means and said receiving means utilize a wired communication link.

51. The apparatus according to claim 45, wherein said transmitting means and said receiving means utilize a fiber optic communication link.

52. The apparatus according to claim 45, wherein said storage means is a storage device chosen from the group consisting of a digital microprocessor, an EEPROM memory chip, DRAM, and RAM.

53. The apparatus according to claim 45, wherein any one of said assigning means, tracking means, commencement means, interpreting means, playback means, executing means, determining means, instructing means, or completion means comprise a software controlled microprocessor.

54. The apparatus according to claim 45, wherein said transmitting means, said receiving means, said storage means, said assigning means, said tracking means, said commencement means, said interpreting means, said executing means, said playback means, said determining means, said second determining means, said instructing means, said second commencement means and said completion means are provided within a separate, releasable unit, and wherein said releasable unit is attachable to an object to permit said object to intercommunicate with other programmable objects.

55. The apparatus according to claim 54, wherein said releasable unit comprises pre-recorded instructions.

56. A method of controlling a plurality of controllable, spontaneously programmable toys in the storage and execution of user input instructions related to a performance of a series of n desired actions, the method comprising the steps of:

(a) causing a selected one toy to signal said plurality of toys that said selected one toy is about to store instructions related to a performance of a first desired action;

(b) storing, in said selected toy, instructions input by a toy user related to said performance of said first desired action;

(c) causing, upon the completion of said toy user's input, said selected one toy to signal said plurality of toys that said storing of instructions in said first selected toy has been completed;

(d) causing each toy of said plurality of toys to prepare to receive instructions related to a performance of a next desired action;

(e) storing, in a next selected toy, instructions input by a next toy user related to said performance of said next desired action;

(f) causing, upon the completion of said next toy user's input, said next selected toy to signal said plurality of toys that said storing of instructions in said next selected toy has been completed;

(g) repeating steps (d) through (f) until instructions related to said performance of said n desired actions have been stored;

(h) causing any one of said plurality of toys to signal that said first selected toy should commence execution of said instructions related to said first action;

(i) causing, in said first selected toy, the execution of said instructions related to said first desired action;

(j) causing, upon the completion of the execution of said first action, said first selected toy to signal said plurality of toys that said performance of said first desired action has completed;

(k) causing said plurality of toys to determine which toy is said next selected toy;

(l) causing said next selected toy to perform said next desired action by executing said instructions related to said next desired action;

(m) causing said next selected toy to signal said plurality of toys that said performance of said next desired action has been completed; and (n) repeating steps (k) through (m) until said n desired actions have been performed.

57. A system for controlling a plurality of controllable, spontaneously programmable toys in the storage and execution of user input instructions related to a performance of a series of n desired actions, the system comprising:

signal means for causing a selected first toy to signal said plurality of toys that said first toy is about to store instructions related to a performance of a first desired action;

memory means for storing, in said first toy, instructions input by a toy user related to said performance of said first desired action;

second signal means for causing, upon the completion of said toy user's input, said first toy to signal said plurality of toys that said storing of said instructions in said first toy has been completed;

preparation means for causing each toy of said plurality of toys to prepare to receive instructions related to a performance of a next desired action;

next toy memory means for storing, in a next toy, instructions input by a next toy user related to said performance of said next desired action;

third signal means for causing, upon the completion of said next toy user's input, said next toy to signal said plurality of toys that said storing of said instructions in said next toy has been completed;

repetition means for causing the further activation of said preparation means, said next toy memory means and said third signal means until instructions related to said performance of said n desired actions have been stored;

commencement means for causing any one of said plurality of toys to signal that said first toy should commence the execution of said instructions related to said first action;

execution means for causing, in said first toy, the execution of said instructions related to said first desired action;

fourth signal means for causing, upon the completion of said performance of said first action, said first toy to signal said plurality of toys that said performance of said first desired action has been completed;

determining means for causing said plurality of toys to determine which toy is said next toy;

next toy performance means for causing said next toy to perform said next desired action by executing said instructions related to said next desired action;

next toy signaling means for causing said next toy to signal said plurality of toys that said performance of said next desired action has been completed; and second repetition means for causing the further activation of said determining means, said next toy performance means and said next toy signaling means until said n desired actions have been performed.

58. The method according to claim 56, wherein said toy user and said next toy user are the same user.

59. The system according to claim 57, wherein said toy user and said next toy user are the same user.

60. A system for storing and performing a series of n desired actions in the order stored, comprising:

a plurality of programmable objects, each object comprising:

memory means for storing instructions related to a performance of a desired action of a series of n desired actions;

tracking means for tracking said instructions that have been stored in said object; and performance means, in communication with said tracking means, for executing said instructions so as to perform said desired action in the order in which said instructions related to said desired action was stored in said object.

* * * * *